US006151863A

United States Patent [19]

Lancaster, III et al.

[11] Patent Number: 6,151,863

[45] Date of Patent: Nov. 28, 2000

[54] METHOD AND APPARATUS FOR STRETCH WRAPPING A LOAD

[75] Inventors: Patrick R. Lancaster, III, Louisville, Ky.; Steven E. DeGrasse, New Albany, Ind.

[73] Assignees: Lantech Management Corp.; Lantech Holding Corp, both of Louisville, Ky.

[21] Appl. No.: 09/065,616

[22] Filed: Apr. 24, 1998

[51] Int. Cl.[7] ..... B65B 13/04

[52] U.S. Cl. ..... 53/399; 53/588

[58] Field of Search ..... 53/588, 210, 587, 53/399, 449, 176, 556, 441

[56] References Cited

U.S. PATENT DOCUMENTS

| | | | |
|---|---|---|---|
| 3,896,604 | 7/1975 | Marantz | 53/176 |
| 4,079,565 | 3/1978 | Lancaster, III et al. . | |
| 4,317,322 | 3/1982 | Lancaster et al. | 53/399 |
| 4,429,514 | 2/1984 | Lancaster et al. | 53/556 |
| 4,658,570 | 4/1987 | Thomas | 53/556 |
| 4,905,448 | 3/1990 | Plitt | 53/399 |
| 5,184,449 | 2/1993 | Hannen | 53/588 X |
| 5,216,871 | 6/1993 | Hannen | 53/588 X |
| 5,673,542 | 10/1997 | Vartanian et al. | 53/588 X |

FOREIGN PATENT DOCUMENTS 0 630 812 A1 12/1994 European Pat. Off. .

*Primary Examiner*—Linda Johnson
*Attorney, Agent, or Firm*—Finnegan, Henderson, Farabow, Garrett & Dunner, L.L.P.

[57] ABSTRACT

A cantilevered packaging material dispenser has an arm rotatable about a generally horizontal axis to wrap packaging material around the top and bottom of the load in a wrapping area. The rotatable arm rotates about a cantilevered load support surface to wrap packaging material around the top and bottom of the load. The cantilevered load support surface includes a free end mounted and movable in the wrapping area between a wrapping position and a load transfer position.

11 Claims, 8 Drawing Sheets

METHOD AND APPARATUS FOR STRETCH WRAPPING A LOAD

BACKGROUND OF THE INVENTION

1. Field of the Invention

The invention relates to wrapping a load with packaging material, and, more particularly, to stretch wrapping.

2. Description of the Related Art

Various packaging techniques have been used to build a load of unit products and subsequently wrap them for transportation, storage, containment and stabilization, protection and waterproofing. One system uses stretch wrapping machines to stretch, dispense, and wrap stretch packaging material around a load. Stretch wrapping can be performed as an inline automated packaging technique which dispenses and wraps packaging material in a stretched condition around a load on a pallet to cover and contain the load. Pallet stretch wrapping, whether accomplished by turntable, rotating arm, or rotating ring typically covers the four vertical sides of the load with a stretchable film such as polyethylene film. In each of these arrangements, relative rotation is provided between the load and a packaging material dispenser to wrap packaging material about the sides of the load.

Wrapping packaging material about the sides of the load typically unitizes and stabilizes the load. However, such side wrapping generally does not cover the top of the load or secure the load to the pallet in a manner which would promote increased stability. Because the structure of typical stretch wrap apparatus, it is difficult to wrap packaging material about the top and bottom of the load to secure the load to the pallet for stability. Previous attempts to wrap packaging material about the top and bottom of a load include holding a palletized load on the tines of a forklift truck, and placing the load and tines supporting the load within a wrapping mechanism to be wrapped. This method required the driver of the forklift truck to carefully control the timing and position of the truck and the wrapping machinery revolving around the load and tines of the forklift truck to wrap packaging material about the top and bottom of the load to avoid undesirable interference between the truck, the load and the wrapping machinery during wrapping.

Alternatively, the top and bottom of a load have been wrapped by conveying a load through a wrapping ring on a conveying mechanism, such that after wrapping, the load is "wrapped" to the conveyor, and the conveyor must move the load and the packaging material away from the wrapping area. Such devices are expensive, requiring structure to keep the load and the packaging material moving at the same speeds along the conveyor, preventing the packaging material from being caught or torn, and arrangements to get electrical power to the rotating portion of the ring for controlling the dispenser mounted on the ring.

In light of these drawbacks, there is a need to wrap the top and bottom of a load with packaging material in a simple, reliable, and inexpensive manner.

SUMMARY OF THE INVENTION

Accordingly, the present invention is directed to a method and apparatus for wrapping a top and bottom of a load with packaging material which provides advantages and obviates a number of problems in earlier methods and apparatus for wrapping a load.

To achieve these and other advantages and in accordance with the purpose of the invention, as embodied and broadly described, one aspect of the invention includes a method of wrapping packaging material around a load in a wrapping area, including positioning a load on a cantilevered load support surface having a free end in the wrapping area, rotating a cantilevered packaging material dispenser on a rotatable arm about a generally horizontal axis to wrap packaging material around the top arid bottom of the load in the wrapping area when the cantilevered load surface is in a wrapping position, where the cantilevered load support surface and the cantilevered packaging material dispenser are generally aligned and intermeshed, moving the cantilevered load support surface to a load transfer position, where the wrapped load may be removed from the free end of the cantilevered load support surface in a generally horizontal direction without interfering with the cantilevered packaging material dispenser, removing the wrapped load from the free end of the cantilevered load support surface in the wrapping area, and transporting the wrapped load away from the cantilevered load support surface and the wrapping area.

Another aspect of the present invention includes an apparatus for wrapping packaging material around the load in a wrapping area, including a cantilevered packaging material dispenser with a free end extending from an arm rotatable about a generally horizontal axis to wrap packaging material around the top and bottom of the load in the wrapping area, and a cantilevered load support surface with a free end mounted and movable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENTS

Figure 1:
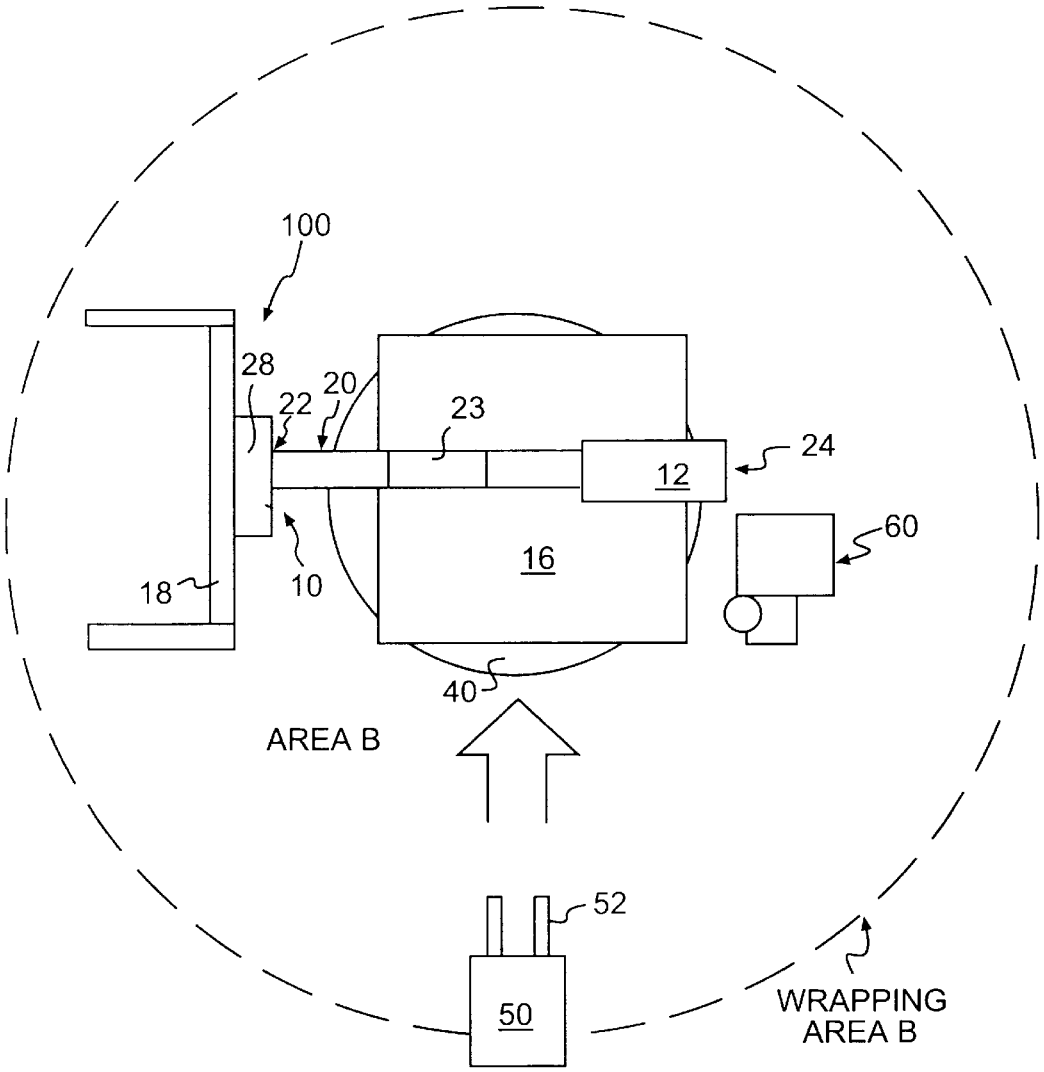
FIG. 1 is a top view of an apparatus for wrapping a load according to a first embodiment of the present invention.

Examples of the following present preferred embodiments of the present invention are illustrated in the accompanying drawings.

One aspect of the invention includes an apparatus provided for wrapping a top and bottom of a load with packaging material. As embodied and shown in FIGS. 1–2, the apparatus for wrapping a load with packaging material includes stretch wrapping apparatus 100.

The invention includes a cantilevered packaging material dispenser with a free end extending from an arm rotatable about a generally horizontal axis to wrap packaging material around the top and bottom of the load in the wrapping area. As embodied and shown in FIGS. 1 and 2, a cantilevered packaging material dispenser 10 includes a dispenser support frame 18, a rotatable arm 20 formed in the shape of an "L" and having a vertical leg 22 rotatably journalled in dispenser support frame 18 and a horizontal leg 23 having a free end 24, and a packaging material dispenser 12 supported on rotatable arm 20 near free end 24. Packaging material dispenser 12 includes a support for a roll of packaging material, such as stretch wrap, contained within a roll carriage, and may also include a variety of rollers, optionally including prestretch rollers for stretching the packaging material longitudinally and/or transversely, to position, dispense, and stretch the packaging material as packaging material 14 is being dispensed from the roll of packaging material. In this preferred embodiment, stretch wrap packaging material is used, however, various other packaging materials such as netting, strapping, banding, or tape can be used as well.

Figure 2:
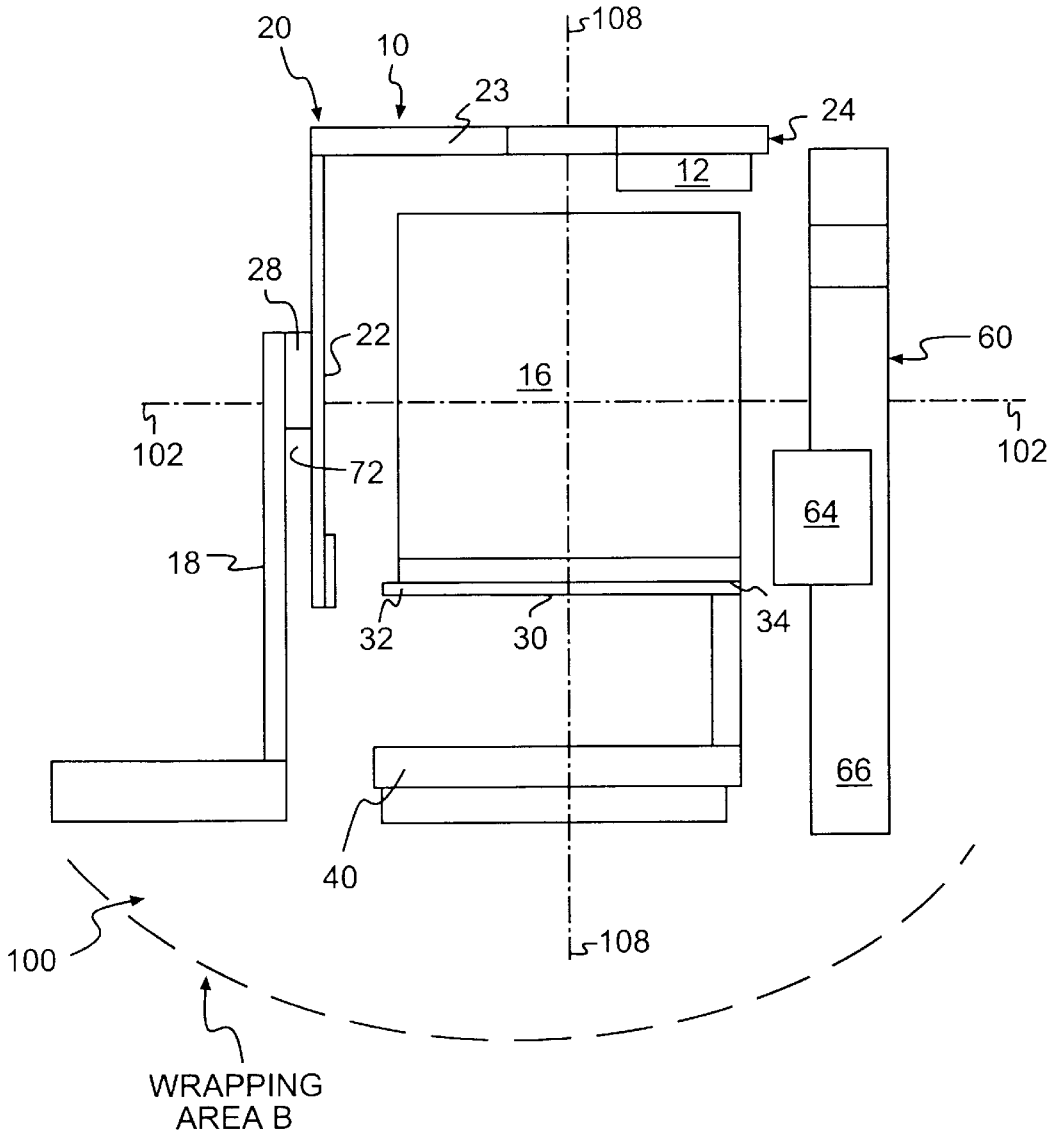
FIG. 2 is a side view of the apparatus shown in FIG. 1.

Packaging material dispenser 12 may be horizontally moveable and motor driven on a horizontal leg 23 of the "L" of rotatable arm 20 to dispense packaging material 14 spirally about load 16 as arm 20 rotates about load 16. As shown in FIGS. 1 and 2, dispenser 12 may be small in size relative to the size of rotatable arm 20, and moveable horizontally along rotatable arm 20 to dispense packaging material 14. Alternatively, dispenser 12 may have a length similar to the size of leg 23 of rolatable arm 20, such that there is no need for dispenser 12 to move along rotatable arm 20 while dispensing packaging material 14. A sheet of packaging material 14 would be of such a size that it would cover a side of load 16 during a single rotation of rotatable arm 20 about load 16.

As shown in FIGS. 1 and 2, a motor drive 28 is provided for providing relative rotation around a generally horizontal axis 102 between the packaging material dispenser 12 and the load 16 to wrap packaging material 14 about the top and bottom of load 16. Drive 28 rotates rotatable arm 20 and dispenser 12 about generally horizontal axis 102 to wrap packaging material around the top and bottom of load 16.

According to the present invention, a cantilevered load support surface with a free end is mounted and moveable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser.

As embodied and shown in FIGS. 1 and 2, cantilevered load support surface 30 includes a free end 32 and a supported portion 34. Free end 32 of cantilevered load support surface 30 is positionable to be generally aligned and intermeshed with the free end 24 of cantilevered packaging material dispenser 10. In this position, defined as a wrapping position, free end 24 of cantilevered packaging material dispenser 10 is aligned so it extends generally parallel to, rather than perpendicular to the cantilevered load support surface 30.

Free end 32 of cantilevered load support surface 30 is intermeshed so it extends within the cylinder of movement described by the rotatable horizontal leg 23 arid the free end 24 of cantilevered packaging material dispenser 10, with the free end 32 of the cantilevered load support generally facing toward dispenser support frame 18. In the wrapping position, wrapping occurs as the free ends 24, 32 are aligned and intermeshed as rotatable arm 20 can rotate about generally horizontal axis 102, to revolve around free end 32 and adjacent to supported portion 34 of cantilevered load support surface 30 to wrap packaging material 14 around free end 32 and load 16.

Because the packaging material 14 is wrapped around load 16 and free end 32, load 16 is banded to cantilevered load support surface 30 such that supported portion 34 of cantilevered load support surface 30 prevents passage of the packaging material and removal of the load from the supported portion 34. Additionally, because load 16 is bound to cantilevered load support surface 30 by packaging material 14, load 16 cannot be removed vertically from load support surface 30. Wrapped load 16 is removed from cantilevered load support surface 30 off free end 32 in a horizontal direction, namely generally parallel with free end 32.

Figure 7:
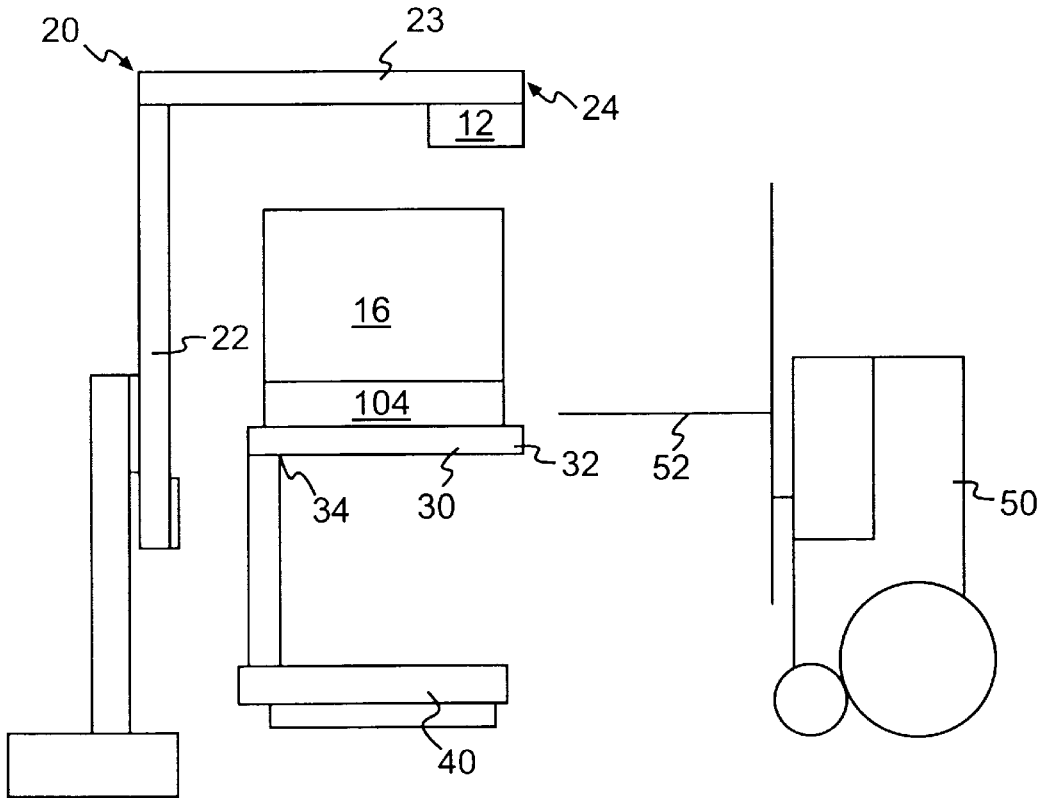
FIG. 7 is a side view of the apparatus of FIG. 2 in use.

Free end 32 of cantilevered load support surface 30 may also be positionable such that free end 32 does not face dispenser support frame 18 of cantilevered packaging material dispenser 10. For example, the free end 32 of the cantilevered support surface may face in the same direction as the free end 24 of the cantilevered packaging material dispenser 10, such that the cantilevered load support surface 30 is generally aligned with the horizontal portion of rotatable arm 20, as shown in FIG. 7. Alternatively, free end 32 may not face dispenser support frame 18 of cantilevered packaging material dispenser 10, and the free end 32 of the cantilevered support surface may not face in the same direction as the free end 24 of the cantilevered packaging material dispenser 10, such that the cantilevered load support surface 30 is not aligned with the horizontal leg 23 of rotatable arm 20, but is somewhat perpendicular to the horizontal leg 23 of rotatable arm 20. In these positions, defined as the load transfer position, it is possible for load 16 to be transferred in a horizontal direction between the free end 32 of load support surface 30 and a load transporter without interfering with cantilevered packaging material dispenser 10, and particularly not interfering with dispenser support frame 18 of the cantilevered packaging material dispenser 10.

Free end 32 of cantilevered load support surface 30 is mounted and moveable in the wrapping area B between the wrapping position and the load transfer position. "Mounted and moveable within the wrapping area" defines the cantilevered load support surface being located in the wrapping area throughout the infeed, wrapping, and outfeed operations. The wrapping area is defined as the area within the general vicinity of the wrapping, as opposed to areas remote from where wrapping occurs, and has been depicted, for example, in the figures as wrapping area B.

In a first embodiment, as shown in FIGS. 1 and 2, cantilevered load support surface 30 is mounted on a turntable 40 which is mounted in the wrapping area B. Turntable 40 is rotatable to move free end 32 of cantilevered load support surface 30 between the wrapping position and the load transfer position. As shown in FIG. 2, free end 32 of cantilevered load support 30 is in a wrapping position and faces dispenser support frame 18 for wrapping load 16, and as shown in FIG. 7, free end 32 of cantilevered load support 30 is in a load transfer position and faces away from dispenser support frame 18 so that load 16 can be removed in a generally horizontal direction from the free end 32.

According to the present invention, a load transporter for transporting and transferring the load from the cantilevered load support and the wrapping area is provided. As embodied herein, the term "forklift truck" is intended to include all such vehicles that pick up, support and transport the load, such as a clamp truck, and including other vehicles generally referred to by other names. Any such vehicle may include support tines, clamps, squeezer clamps, or any other pull pack attachments or adder components for gripping or picking up a load.

As embodied and shown in FIGS. 1, 2, and 7, the load transporter may include a forklift truck 50 having support tines 52. After the load is wrapped, turntable 40 rotates to move free end 32 of cantilevered load support 30 to the load transfer position. Forklift truck 50 moves into wrapping area B, and using support tines 52 removes wrapped load 16 in a generally horizontal direction from the free end 32 of cantilevered load support 30, and transports the wrapped load out of the wrapping area B to a storage or shipping area. As shown in FIG. 7, it is possible to align the support tines 52 of forklift truck 50 with a pallet 104 supporting load 16 to facilitate removing load 16 from free end 32 of cantilevered load support surface 30. Because packaging material 14 is wrapped about load 16 and the cantilevered load support surface 30, holes in pallet 104 supporting load 16 are accessible to support tines 52. In this configuration, forklift truck 50 inserts tines 52 into holes in pallet 104 and pulls load 16 off free end 32 of cantilevered load support surface 30, also pulling packaging material 14 along with load 16 such that packaging material 14 wrapped about cantilever load support surface 30 slides off of free end 32 to snap into place underneath load 16 as it is removed from free end 32.

If load 16 is not on a pallet, other options may be more desirable to remove load 16 from cantilevered load support surface 30. For example, a pushing mechanism may be used to push load 16 off of free end 32 of cantilevered load support surface 30 and onto the load transporter. Alternatively, cantilevered load support surface 30 may be moveable between a load infeed conveyor and a load outfeed conveyor, such that free end 32 receives the load, moves into the wrapping position, and moves to the load transfer position to allow load 16 to be transferred to a conveyor mechanism which will convey both load 16 and packaging material 14, above and below the conveyor, respectively.

Additionally, it is possible to use forklift truck 50 to transport load 16 into wrapping area B and transfer load 16 onto cantilevered load support surface 30. It is preferable but not necessary that a load be transferred onto cantilevered load support surface 30 in a horizontal direction from the free end 32 of cantilevered load support surface 30. It may be transferred onto load support surface 30 from the supported portion 34, or from one of the sides. In a less preferred embodiment, load 16 may be transferred onto cantilevered load support surface 30 from a vertical direction.

According to one aspect of the present invention, apparatus 100 may include means for providing relative rotation about a generally vertical axis between a dispenser and the load to wrap packaging material around the sides of the load. As embodied and shown in FIGS. 1 and 2, turntable 40 is rotatable about a generally vertical axis 108 to provide relative rotation between load 16 and a packaging material dispenser.

As shown in FIGS. 1 and 2, a second packaging material dispenser 60 may be provided. Packaging material dispenser 60 dispenses a sheet of packaging material 62 in a web form. Packaging material dispenser 60 includes a roll of packaging material contained within a roll carriage 64 and may also include a variety of rollers, optionally including prestretch rollers for stretching the packaging material longitudinally and/or transversely, to position, dispense, and stretch the packaging material 62 as packaging material 62 is being dispensed from the roll of packaging material. Roll carriage 64 of dispenser 60 is vertically moveable on mast 66 to dispense packaging material 62 spirally about load 16 as turntable 40 rotates load 16. Alternatively, a second packaging material dispenser mounted on a rotatable arm may be used. In a preferred embodiment, stretch wrap packaging material is used, however various other packaging materials such as netting, strapping, banding, or tape can be used as well.

Alternatively, the same packaging material dispenser may be used to wrap packaging material around the top and bottom of the load as well as the sides of the load. For example, rotatable arm 20 might include an extendable portion for extending vertically downward from rotatable arm 20 and upon which dispenser 12 might move vertically along such an extensible portion to dispense packaging material 14 spirally about load 16 as turntable 40 rotates load 16.

According to the present invention, apparatus 100 preferably includes a controller, such as a microprocessor, or an electromechanical or other controller. The controller is preferably an integrated controller that controls several of the various operations in the wrapping process such as the movement of the cantilevered load support surface between the wrapping position and the load transfer position, the rotation of the rotatable arm and dispenser, the rotation of the turntable, or a combination of any or all of the above. This is in contrast to using one controller to operate the wrapper and another, separate controller such as a forklift truck, to control the positions of the load during holding and positioning of the load during wrapping.

Figure 3:
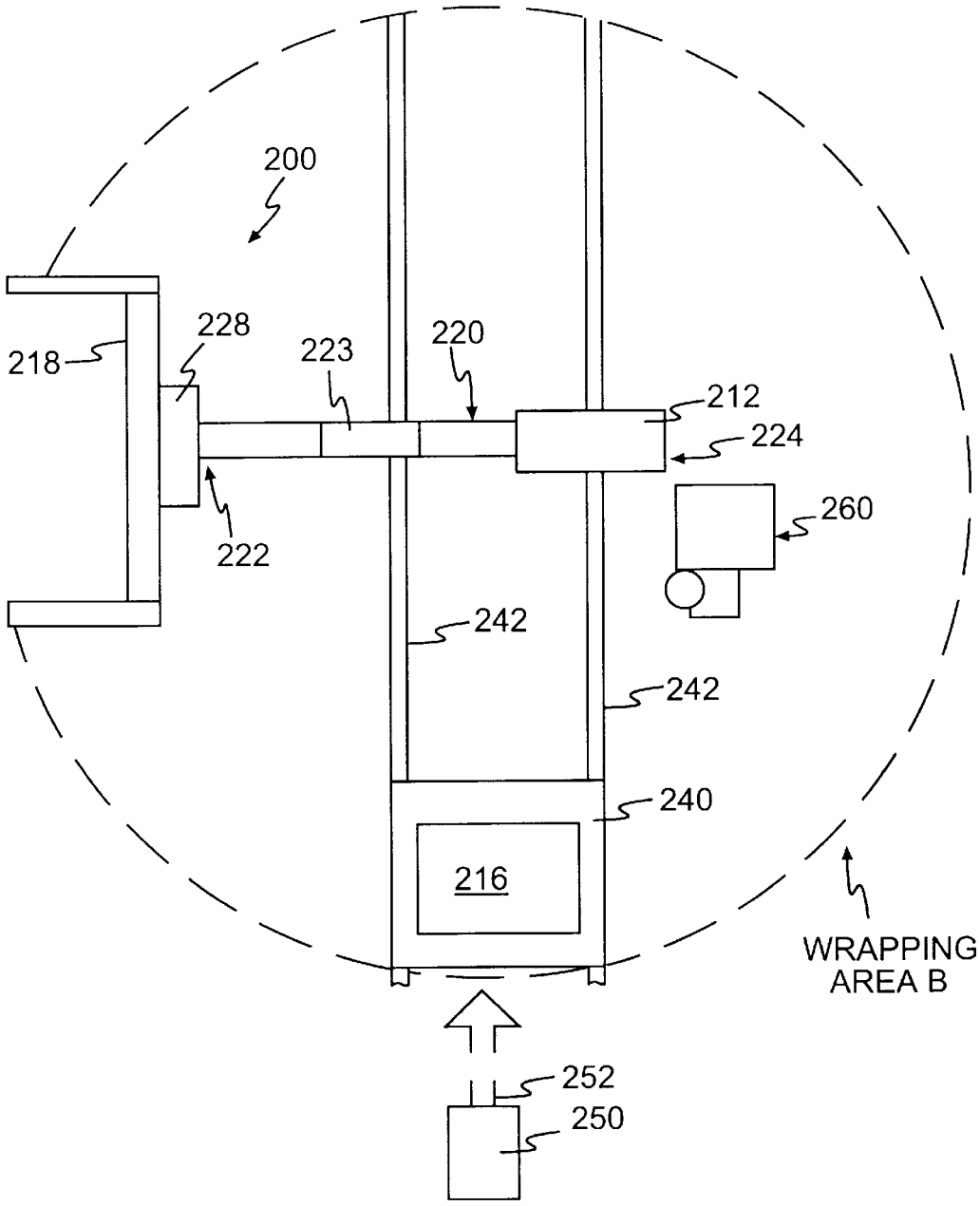
FIG. 3 is a top view of an apparatus for wrapping a load according to a second embodiment of the present invention.
Figure 4:
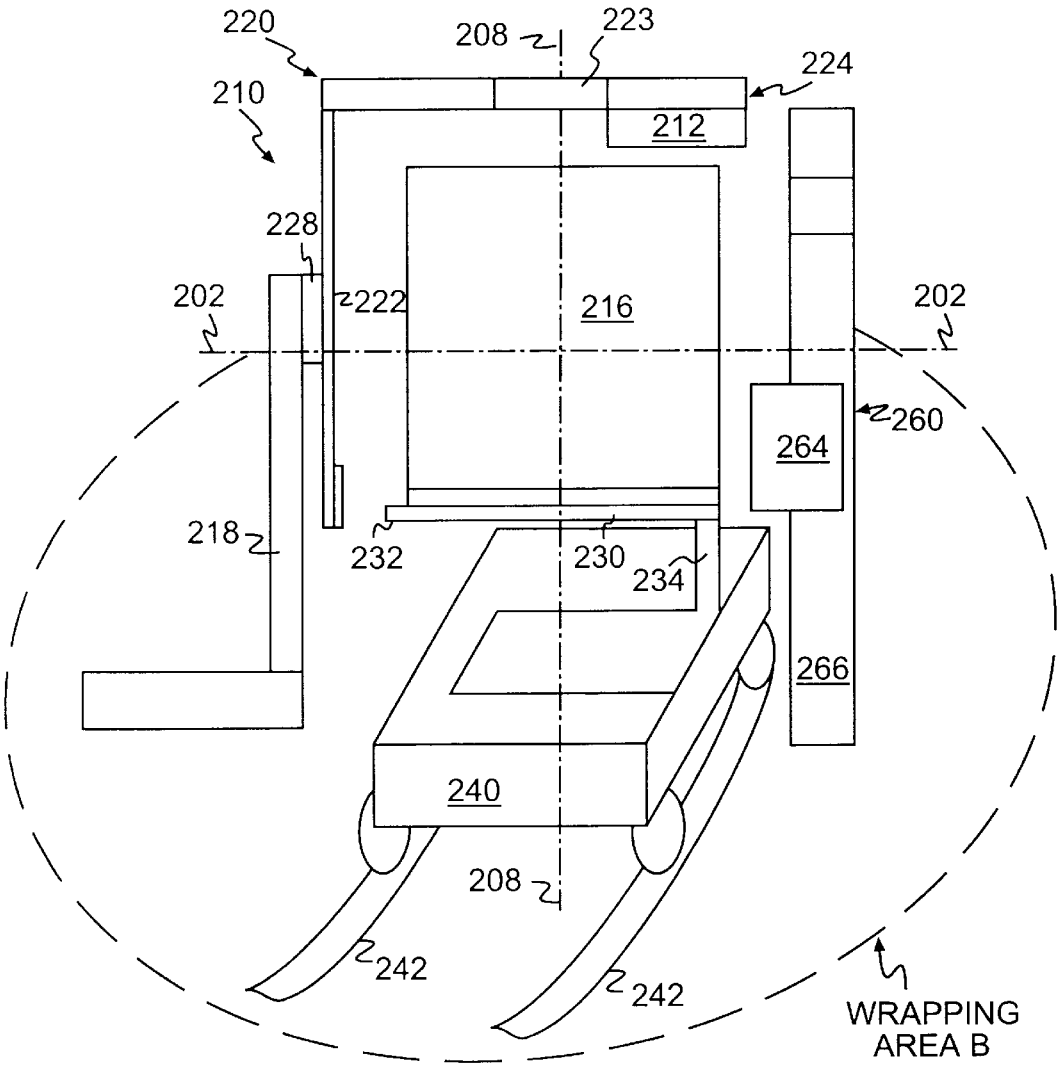
FIG. 4 is a side view of the apparatus shown in FIG. 3.

According to another embodiment of the present invention shown in FIGS. 3 and 4, in which similar numerals designate similar components, an apparatus for wrapping a top and bottom of a load with packaging material includes apparatus 200. As shown in FIGS. 3 and 4, packaging material dispenser 212 is mounted on "L" shaped rotatable arm 220 which is supported by dispenser support frame 218 and driven by drive 228.

As embodied in FIGS. 3 and 4, cantilevered load support surface 230 is mounted on a shuttle cart 240. Shuttle cart 240 is mounted on rails 242 within wrapping area B and translates on rails 242 to move free end 232 of load support surface 230 between the wrapping position and the load transfer position.

Thus, in the wrapping position, as in the first embodiment, free end 232 of cantilevered load support surface 230 is positionable to be generally aligned and intermeshed with the free end 224 of cantilevered packaging material dispenser 210. In this position, defined and shown in FIG. 8 as a wrapping position, free end 224 of cantilevered packaging material dispenser 210 is aligned so it extends generally parallel to, rather than perpendicular to the cantilevered load support surface 230.

Free end 232 of cantilevered load support surface 230 is intermeshed so it extends within the cylinder of movement described by the rotatable horizontal leg 223 and free end 224 of cantilevered packaging material dispenser 210, with free end 232 generally facing toward dispenser support frame 218. In the wrapping position, wrapping occurs as the free ends 224, 232 are aligned and intermeshed as rotatable arm 220 can rotate about generally horizontal axis 202, to revolve around free end 232 and adjacent supported portion 234 of cantilevered load support surface 230 to wrap packaging material 214 around free end 232 and load 216.

Figure 8:
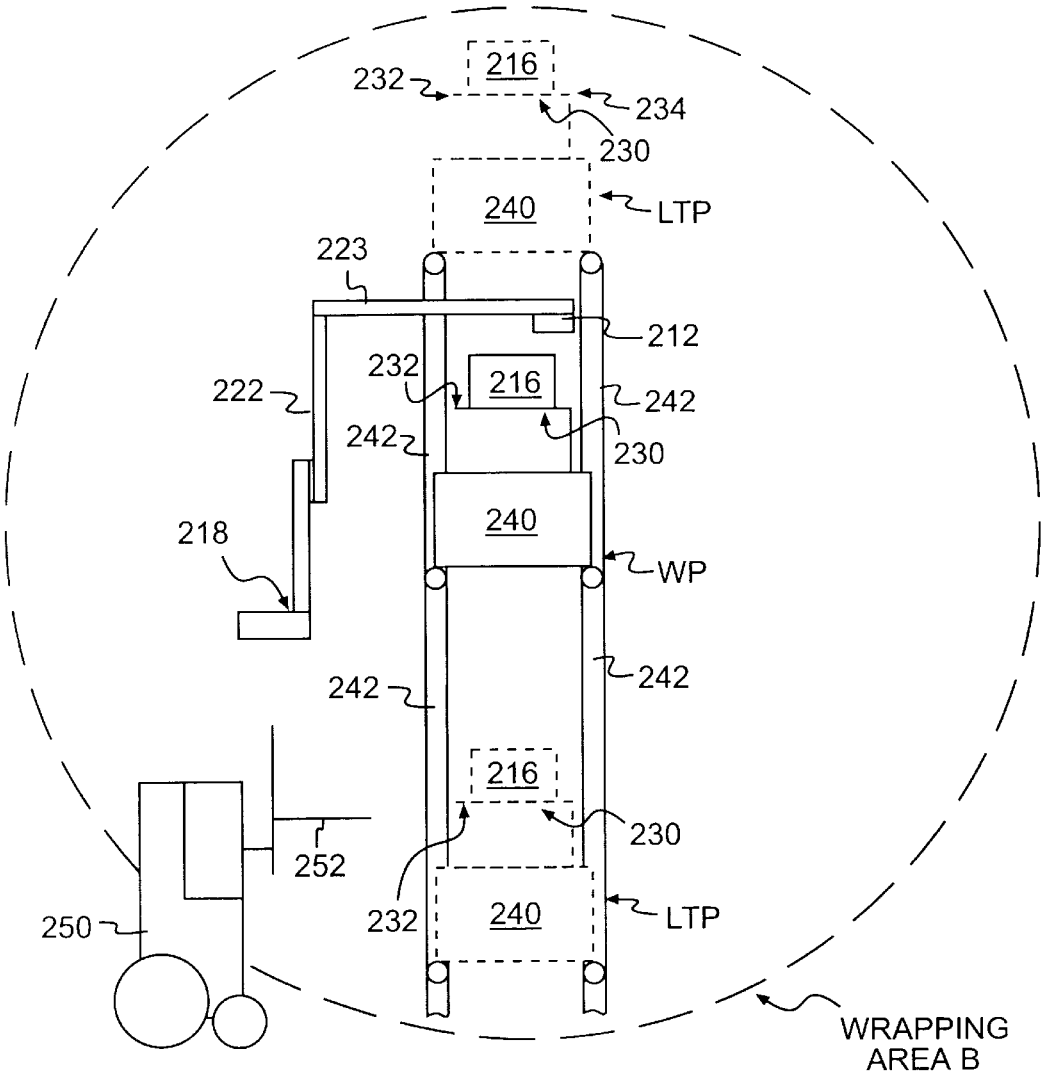
FIG. 8 is a perspective view of the apparatus of FIG. 4 in use.

Free end 232 of cantilevered load support surface 230 may also be positionable such that free end 232 does not face dispenser support frame 218 of cantilevered packaging material dispenser 210. For example, the free end 232 of the cantilevered support surface may still face in the same direction as in the wrapping position, however it has been translated such that the cantilevered load support surface 230 is no longer aligned with or underneath the horizontal portion of rotatable arm 220, as shown in FIG. 8. In this position, defined as the load transfer position LTP, it is possible for load 216 to be transferred in a horizontal direction between the free end 232 of load support surface 230 and a load transporter without interfering with dispenser support frame 218 of cantilevered packaging material dispenser 210.

Free end 232 of cantilevered load support surface 230 is mounted and moveable in the wrapping area B between the wrapping position and the load transfer position. In the second embodiment, as shown in FIGS. 3, 4, and 8, cantilevered load support surface 230 is mounted on shuttle cart 2 40 which is mounted on rails 242 within the wrapping area B. Shuttle cart 240 is translatable along rails 242 to move free end 232 of cantilevered load support surface 230 between the wrapping position WP and the load transfer position LTP as seen in FIG. 8. As shown in FIG. 4, free end 232 of cantilevered load support 230 faces dispenser support frame 218 for wrapping load 216, and as shown in FIG. 8, free end 232 of cantilevered load support 230 does not face dispenser support frame 218 so that load 216 can be removed in a generally horizontal direction from the free end 232.

According to the present invention, a second wrapping mechanism for wrapping the sides of the load may optionally be provided. In a first embodiment, the second wrapping mechanism may be positioned near the cantilevered packaging material dispenser 210, such that it is possible to wrap packaging material around the sides of load 216 while the load is in the wrapping position WP. Alternatively, the second wrapping mechanism may be positioned within the wrapping area but distant from the cantilevered packaging material dispenser, along rails 242 such that shuttle cart 240 can move load 216 and cantilevered load support surface 230 to a second wrapping position. The second wrapping position may be at the load transfer position LTP or between the wrapping position WP and the load transfer position LTP.

The second wrapping mechanism may include a second arm, rotatable about a generally vertical axis and supporting a second packaging material dispenser moveable vertically along the second arm. As the second arm rotates about load 216, the second packaging material dispenser moves vertically along the arm to dispense packaging material about the sides of load 216.

The load transporter and controller can be similar to those described with respect to FIGS. 1, 2, and 7.

Figure 5:
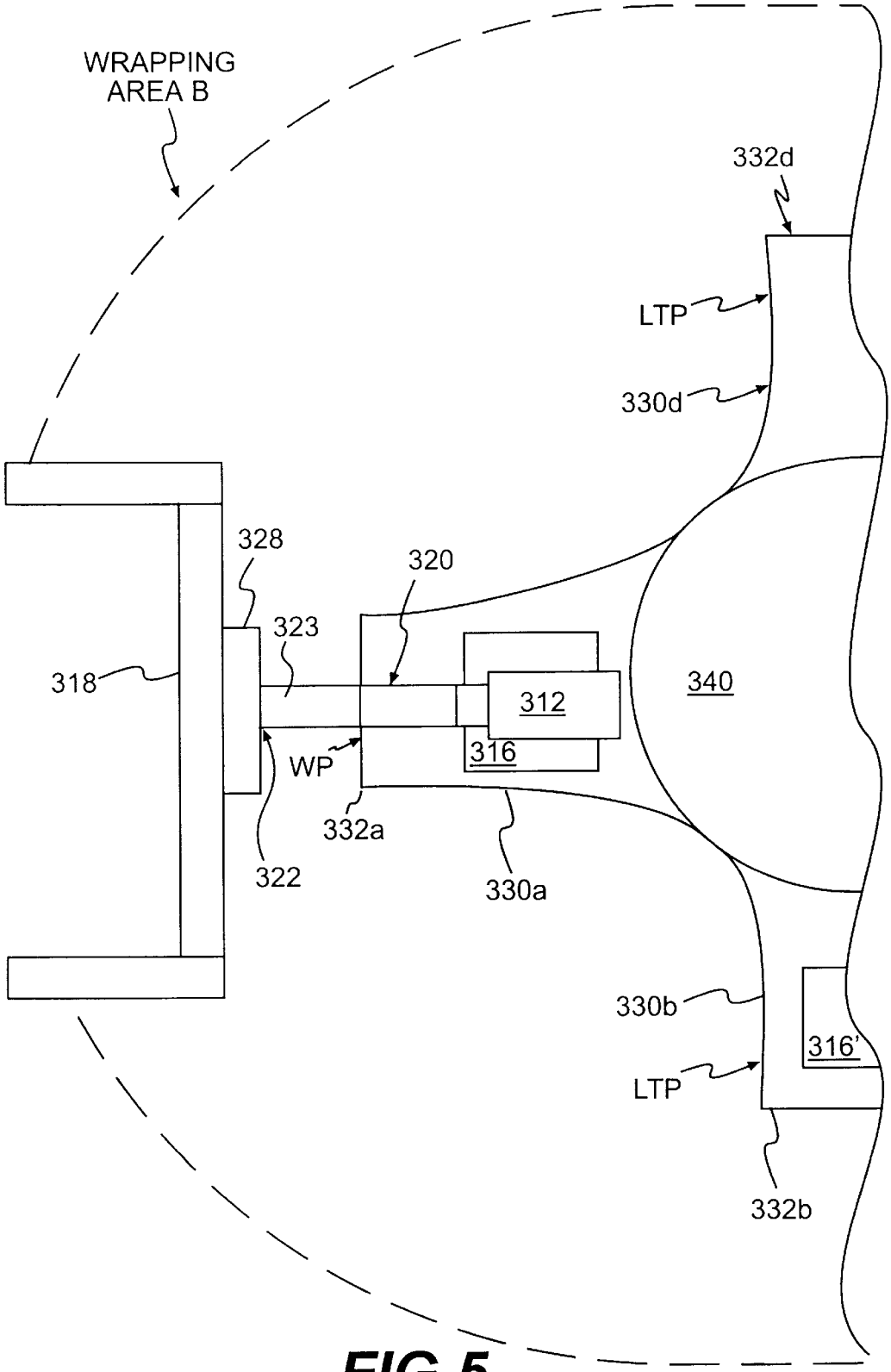
FIG. 5 is a top view of an apparatus for wrapping a load according to a third embodiment of the present invention.
Figure 6:
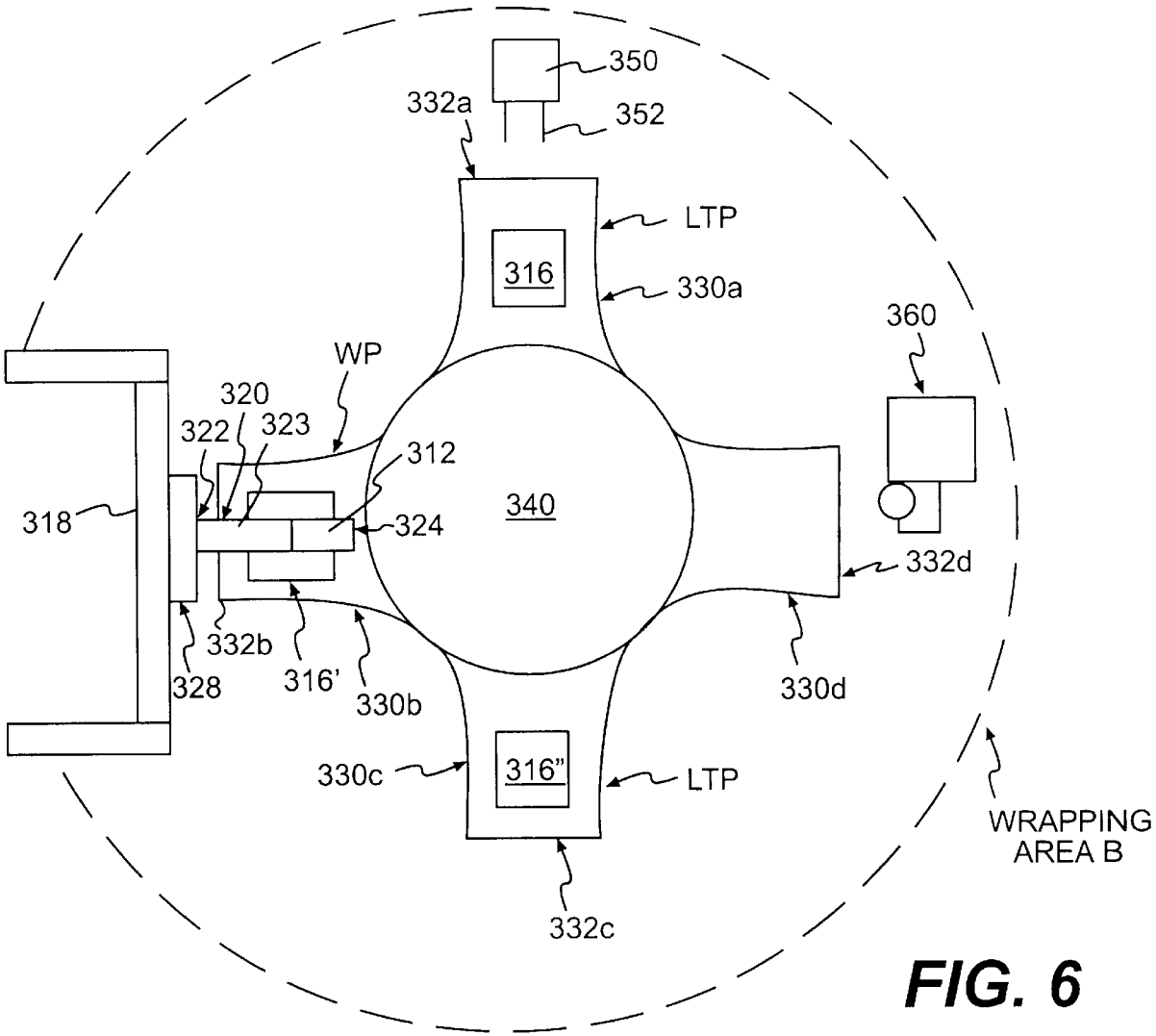
FIG. 6 is also a top view of the apparatus shown in FIG. 5.

According to another embodiment of the present invention shown in FIGS. 5 and 6, in which similar numerals designate similar components, an apparatus for wrapping a top and bottom of a load with packaging material includes apparatus 300. As shown in FIGS. 5 and 6, packaging material dispenser 312 is mounted on "L" shaped rotatable arm 320 which is supported by dispenser support frame 318 and driven by drive 328.

In this embodiment, a plurality cantilevered load support surfaces 330*a*, 330*b*, 330*c*, 330*d*, each for supporting a separate load, are provided. Cantilevered load support surfaces 330*a*, 330*b*, 330*c*, and 330*d* extend in different directions from a central platform 340. Central platform 340 is rotatable within wrapping area B to move free ends 332*a*, 332*b*, 332*c*, 332*d* of cantilevered load support surfaces 330*a*, 330*b*, 330*c*, 330*d*, respectively, between the wrapping position WP and the load transfer position LTP.

It is preferable that the cantilevered load support surfaces 330*a*, 330*b*, 330*c*, 330*d* are spatially arranged such that when one of the cantilevered load support surfaces 330*a*, 330*b*, 330*c*, 330*d* is in the load wrapping position, at least one other of the cantilevered load support surfaces 330*a*, 330*b*, 330*c*, 330*d* is located in a load transfer position. That is, the plurality of cantilevered load support surfaces 330*a*, 330*b*, 330*c*, 330*d* extend in different directions from the central platform 340 which rotates within the wrapping area to sequentially arrange each cantilevered load support surface 330*a*, 330*b*, 330*c*, 330*d* in the load wrapping position and the load transfer position.

In this embodiment, it is possible that two load transfer positions may exist, an on-loading load transfer position for introducing an unwrapped load to the wrapping area, and an unloading load transfer position for removing a wrapped load from the wrapping area. It is preferable that each load transfer position be located such that the load may be transferred in a horizontal direction between the free end of a cantilevered load support surface 330*a*, 330*b*, 330*c*, 330*d* and a load transporter without interfering with dispenser support 318. However, it is not necessary that a load be transferred onto cantilevered load support surface 330*a*, 330*b*, 330*c*, 330*d* in a horizontal direction from the free end 332*a*, 332*b*, 332*c*, 332*d* of cantilevered load support surface 330*a*, 330*b*, 330*c*, 330*d*. In a less preferred embodiment, load 316 may be transferred onto cantilevered load support surface 330*a*, 330*b*, 330*c*, 330*d* from a vertical direction.

Alternatively, the plurality of cantilevered load support surfaces 330*a*, 330*b*, 330*c*, 330*d* may not be supported by a rotatable platform. Instead, the plurality of cantilevered load support surfaces 330*a*, 330*b*, 330*c*, 330*d*, each for supporting a separate load, may be supported and extend in the same direction from a common platform which is translatable within the wrapping area to sequentially arrange each cantilevered load support surface in the load wrapping position and the load transfer position.

According to the present invention, a second wrapping mechanism for wrapping the sides of the load may optionally be provided. In a first embodiment, the second wrapping mechanism may be positioned near the cantilevered packaging material dispenser 310, such that it is possible to wrap packaging material around the sides of load 316 while the load is in the wrapping position. Alternatively, the second wrapping mechanism may be positioned within the wrapping area but distant from the cantilevered packaging material dispenser, such that central platform 340 can move load 316 and the cantilevered load support surface 330*a*, 330*b*, 330*c*, 330*d* supporting load 316 to a second wrapping position. The second wrapping position may be at the load transfer position or between the wrapping position and the load transfer position.

The second wrapping mechanism may include a second arm, rotatable about a generally vertical axis and supporting a second packaging material dispenser moveable vertically along the second arm. As the second arm rotates about load 316, the second packaging material dispenser moves vertically along the arm to dispense packaging material about the sides of load 316.

The load transporter and controller can be similar to those described with respect to FIGS. 1, 2, and 7.

A method for wrapping a load according to the present invention is shown in FIGS. 1, 2, and 7. As shown and according to a preferred embodiment of the present invention, a load 16 is transported by a forklift 50 into a wrapping area B and is then transferred to a cantilevered load support surface 30 mounted in the wrapping area, the wrapping area B having a cantilevered packaging material dispenser 10 including a dispenser 12, a rotatable arm 20 having a free end 24 and supporting dispenser 12, and a dispenser support frame 18.

Once load 16 is positioned on cantilevered load support surface 30, a free end 32 of cantilevered load support surface 30 is moved into a wrapping position, where free end 32 of cantilevered load support surface 30 is positioned such that it faces generally toward dispenser support frame 18 and is generally aligned with the horizontal portion of rotatable arm 20, while the free end 24 of rotatable arm 20 faces generally away from dispenser support frame 18. Free end 32 of cantilevered load support surface 30 is moved into the wrapping position by rotation of turntable 40 on which it is mounted.

A leading end portion of a sheet of packaging material 14 is attached to the load, or the load support surface, and motor driven "L-shaped" rotatable arm 20 begins to rotate dispenser 12 in a circle about a horizontal axis 102 and about load 16 sitting on cantilevered load support surface 30. As rotatable arm 20 rotates, dispenser 12 moves horizontally along rotatable arm 20 and dispenses packaging material 14 around the top, and as arm 20 passes below free end 32 of cantilevered load support surface 30, the bottom of load 16.

Once packaging material 14 has been wrapped around the top and bottom of load 16, the packaging material 14 is severed, and optionally may be smoothed onto load 16 in a conventional way. At this time, it is possible to wrap the sides of the load if so desired. Relative rotation is provided about a generally vertical axis 108 between load 16 and a second packaging material dispenser 60 mounted and vertically moveable on mast 66. In the preferred embodiment, turntable 40 rotates about vertical axis 108 to rotate load 16 and wrap packaging material 62 about the sides of load 16. In an alternative, less preferred embodiment, dispenser 12 is manipulated to extend downwardly from rotatable arm 20, and turntable 40 rotates to provide relative rotation between dispenser 12 and load 16 to wrap packaging material around the sides of the load. Alternatively, it is possible to perform wrapping the sides of the load after the free end 32 has been moved to the load transfer position.

After the sides of load 16 have been wrapped, turntable 40 rotates to move the free end 32 of cantilevered load support surface 30 to a load transfer position, where free end 32 of cantilevered load support surface 30 is positioned such that it generally does not face toward dispenser support 18. It may face in the same direction as free end 24 of cantilevered packaging material dispenser 12 and be aligned with the horizontal portion of rotatable arm 20, or alternatively, free end 32 may not face in the same direction as free end 24 of cantilevered packaging material dispenser 12 and the cantilevered load support surface 30 may be somewhat askew of or perpendicular to the horizontal portion of rotatable arm 20. In either instance, the free end 32 is positioned such that access to it is no longer blocked by dispenser support frame 18 of the cantilevered packaging dispenser. If the sides of the load have not been previously wrapped, it is possible to do so at this point.

Once free end 32 is positioned in the load transfer position, the wrapped load 16 is removed in a generally horizontal direction from free end 32 of cantilevered load support surface 30. As shown in FIG. 7, forklift truck 50 faces and aligns support tines 52 with free end 32 of cantilevered load support surface 30 to remove the load from the free end 32 of cantilevered load support surface 30. Tines 52 are placed into holes of pallet 104 to pick up and remove load 16 from the free end 32. As load 16 is removed, packaging material 14 wrapped around cantilevered load support surface 30 slides off of free end 32 and snaps into place about load 16. Once the load is removed, forklift truck 50 transports wrapped load 16 away from the cantilevered load support surface 30 and the wrapping area B.

As can be seen, with this embodiment, a simple inexpensive turntable that merely moves only rotationally about a vertical axis may be used to position the load, and it also may be used to wrap the load sides. All of the functions can be controlled with a typical programmed microprocessor or other controller devices such as those conventionally used with stretch wrapping apparatus.

In the second embodiment of the present invention, as shown in FIGS. 3, 4, and 8, a load 216 is transported by a forklift 250 into a wrapping area B and is then transferred to a cantilevered load support surface 230 mounted on a shuttle cart 240 mounted, for example, on rails 242 in the wrapping area, the wrapping area B having a cantilevered packaging material dispenser 210 including a dispenser 212, a rotatable arm 220 having a free end 224 and supporting dispenser 212, and a dispenser support 218.

Once load 216 is positioned on cantilevered load support surface 230, a free end 232 of cantilevered load support surface 230 is moved into the wrapping position, as discussed with respect to the first embodiment, by translation of shuttle cart 240 on rails 242 within the wrapping area B.

A leading end portion of a sheet of packaging material 214 is attached to the load, or the load support surface, and motor driven "L-shaped" rotatable arm 220 begins to rotate dispenser 212 in a circle about a horizontal axis 202 and about load 216 sitting on cantilevered load support surface 230. As rotatable arm 220 rotates, dispenser 212 moves horizontally along rotatable arm 220 and dispenses packaging material 214 around the top, and as arm 220 passes below free end 232 of cantilevered load support surface 230, the bottom of load 216.

Once the top and bottom of load 216 is wrapped, the packaging material is severed, and optionally may be smoothed onto the load. At this time, the sides of the load may be wrapped if desired.

A second wrapping mechanism including a second arm having a second packaging material dispenser rotatable about a vertical axis is actuated, and the second packaging material dispenser moves vertically along the second arm as it rotates about the load 216 to dispense packaging material about the sides of the load 216. Alternatively, the wrapping of the sides of the load 216 may be performed after the free end 232 of the cantilevered load support surface 230 is moved to the load transfer position.

After the sides of load 216 have been wrapped, if so desired, shuttle cart 240 translates along rails 242 to move the free end 232 of cantilevered load support surface 230 to a load transfer position, where free end 232 of cantilevered load support surface 230 is positioned such that it generally does not face toward dispenser support 218, and that access to it is no longer blocked by dispenser support frame 218.

If the sides of the load 16 have not been wrapped, it is possible for shuttle cart 240 to translate along rails 242 to move free end 232 and load 216 to a second wrapping mechanism. The second wrapping mechanism provides relative rotation about a vertical axis between load 216 and a second packaging material dispenser to rotate the second packaging material dispenser around load 216 and wrap packaging material around the sides of load 216.

Once free end 232 is positioned in the load transfer position, and after the sides of the load have been wrapped if so desired, the wrapped load 216 is removed in a generally horizontal direction from free end 232 of cantilevered load support surface 230. As shown in FIG. 8, forklift truck 250 faces and aligns support tines 252 with free end 232 of cantilevered load support surface 230 and holes of pallet 204 to remove the load and the packaging material 214 from the free end 232 of cantilevered load support surface 230. Once the load is removed, forklift truck 250 transports wrapped load 216 away from the cantilevered load support surface 230 and the wrapping area B.

Alternatively, and as discussed in the third embodiment of the present invention and as shown in FIGS. 5 and 6, a load 316 is transported by a forklift 350 into a wrapping area B and is then transferred to one of a plurality of cantilevered load support surface 330*a*, 330*b*, 330*c*, 330*d*, each for supporting a separate load, and extending in different directions from a central platform 340 mounted in the wrapping area, the wrapping area B having a cantilevered packaging material dispenser 310 including a dispenser 312, a rotatable arm 320 having a free end 324 and supporting dispenser 312, and a dispenser support 318.

Once load 316 is positioned on a cantilevered load support surface 330*a*, 330*b*, 330*c*, 330*d*, a free end 332*a*, 332*b*, 332*c*, 332*d* of cantilevered load support surface 330*a*, 330*b*, 330*c*, 330*d*, bearing load 316 is moved into a wrapping position by rotation of central platform 340 on which it is mounted. Alternatively, central platform 340 may not be rotatable, but rather mounted translatable within the wrapping area, such as on a shuttle cart, and all of the cantilevered load support surfaces 330*a*, 330*b*, 330*c*, 330*d*may extend in the same direction from platform 340. In this instance, central platform 340 translates to move the loaded free end 332*a*, 332*b*, 332*c*, 332*d* of cantilevered load support surface 330*a*, 330*b*, 330*c*, 330*d* into the wrapping position.

Once load 316 and free end 332*a*, 332*b*, 332*c*, 332*d* of cantilevered load support surface 330*a*, 330*b*, 330*c*, 330*d* are positioned in the wrapping position, a new load 316' may be transported by a forklift 350 into wrapping area B and then transferred to another one of the plurality of cantilevered load support surface 330*a*, 330*b*, 330*c*, 330*d*in the wrapping area.

A leading end portion of a sheet of packaging material 314 is attached to the load, or the load support surface, and motor driven "L-shaped" rotatable arm 320 begins to rotate dispenser 312 in a circle about a horizontal axis 302 and about load 316 sitting on cantilevered load support surface 330*a*, 330*b*, 330*c*, 330*d*. As rotatable arm 320 rotates, dispenser 312 moves horizontally along rotatable arm 320 and dispenses packaging material 314 around the top, and as arm 320 passes below free end 332*a*, 332*b*, 332*c*, 332*d* of cantilevered load support surface 330*a*, 330*b*, 330*c*, 330*d*, the bottom of load 316.

Once the top and bottom of load 316 is wrapped, the packaging material is severed, and optionally may be smoothed onto the load 316. At this time, the sides of the load may be wrapped if desired.

A second wrapping mechanism including a second arm having a second packaging material dispenser rotatable about a vertical axis is actuated, and the second packaging material dispenser moves vertically along the second arm as it rotates about the load 316 to dispense packaging material about the sides of the load 316. Alternatively, the wrapping of the sides of the load 316 may be performed after the free end 332*a*, 332*b*, 332*c*, 332*d* of the cantilevered load support surface 330*a*, 330*b*, 333*c*, 330*d* supporting load 316 is moved to the load transfer position.

After the sides of load 316 have been wrapped, if so desired, central platform 340 rotates to move the free end 332*a*, 332*b*, 332*c*, 332*d* of cantilevered load support surface 330*a*, 330*b*, 330*c*, 330*d* holding wrapped load 316 to a load transfer position, where free end 332*a*, 332*b*, 332*c*, 332*d* of cantilevered load support surface 330*a*, 330*b*, 330*c*, 330*d* holding wrapped load 316 is positioned such that it generally does not face toward dispenser support 318, and that access to it is no longer blocked by dispenser support 318. At the same time, the free end 332*a*, 332*b*, 332*c*, 332*d* of cantilevered load support surface 330*a*, 330*b*, 330*c*, 330*d* holding load 316' is moved into the wrapping position for wrapping, and a new load 316" may be transported by a forklift 350 into a wrapping area B and then transferred to another unoccupied one of the plurality of cantilevered load support surface 330*a*, 330*b*, 330*c*, 330*d* in the wrapping area.

If the sides of the load 316 have not been wrapped, it is possible for central platform 340 to rotate to move free end 332*a*, 332*b*, 332*c*, 332*d* of cantilevered load support surface 330*a*, 330*b*, 330*c*, 330*d* holding load 316 to a second wrapping mechanism. The second wrapping mechanism provides relative rotation about a vertical axis between load 316 and a second packaging material dispenser to rotate the second packaging material dispenser around load 316 and wrap packaging material around the sides of load 316.

Once free end 332*a*, 332*b*, 332*c*, 332*d* of cantilevered load support surface 330*a*, 330*b*, 330*c*, 330*d* is positioned in the load transfer position, the wrapped load 316 is removed in a generally horizontal direction from free end 332*a*, 332*b*, 332*c*, 332*d*of cantilevered load support surface 330*a*, 330*b*, 330*c*, 330*d*. As shown in FIG. 6, forklift truck 350 faces and aligns support tines 352 with free end 332*a*, 332*b*, 332*c*, 332*d* of cantilevered load support surface 330*a*, 330*b*, 330*c*, 330*d* holding wrapped load 316 to remove wrapped load 316 from the free end 332*a*, 332*b*, 332*c*, 332*d* of cantilevered load support surface 330*a*, 330*b*, 330*c*, 330*d*. Once the load is removed, forklift truck 350 transports wrapped load 316 away from the cantilevered load support surface 330*a*, 330*b*, 330*c*, 330*d* and the wrapping area B.

If platform 340 is not a central rotatable platform, but rather is a common platform having cantilevered load support surfaces 330*a*, 330*b*, 330*c*, 330*d* with free ends 332*a*, 332*b*, 332*c*, 332*d* of cantilevered load support surfaces 330*a*, 330*b*, 330*c*, 330*d* extending in the same direction from a side of common platform 340, the method used is essentially the same. The difference is the type of motion between on-loading, wrapping, and off-loading positions would be translation, as discussed with respect to the second embodiment, as opposed to the rotation discussed here.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

What is claimed is:

1. A method of wrapping packaging material around a load in a wrapping area, comprising:

positioning a load on a cantilevered load support surface having a free end and being mounted on a turntable in the wrapping area;

rotating a cantilevered packaging material dispenser on a rotatable arm about a generally horizontal axis to wrap packaging material around the top and bottom of the load in the wrapping area when the cantilevered load surface is in a wrapping position, where the cantilevered load support surface and the cantilevered packaging material dispenser are generally aligned and intermeshed;

moving the cantilevered load support surface to a load transfer position, where the wrapped load may be removed from the free end of the cantilevered load support surface in a generally horizontal direction without interfering with the cantilevered packaging material dispenser;

removing the wrapped load from the free end of the cantilevered load support surface in the wrapping area by rotating the turntable such that the free end of the load support surface faces and is aligned with tines of a forklift to transfer the load from the free end of the load support surface to the forklift a forklift truck; and transporting the wrapped load away from the cantilevered load support surface and the wrapping area with the forklift truck.

2. A method of wrapping packaging material around a load in a wrapping area, comprising:

positioning a load on a cantilevered load support surface having a free end and being mounted on a turntable in the wrapping area;

rotating a cantilevered packaging material dispenser on a rotatable arm about a generally horizontal axis to wrap packaging material around the top and bottom of the load in the wrapping area when the cantilevered load surface is in a wrapping position, where the cantilevered load support surface and the cantilevered packaging material dispenser are generally aligned and intermeshed;

rotating the turntable to move the cantilevered load support surface to a load transfer position, where the wrapped load may be removed from the free end of the cantilevered load support surface in a generally horizontal direction without interfering with the cantilevered packaging material dispenser;

removing the wrapped load from the free end of the cantilevered load support surface in the wrapping area; and transporting the wrapped load away from the cantilevered load support surface and the wrapping area.

3. A method of wrapping packaging material around a load in a wrapping area, comprising:

positioning a load on a selected one of a plurality of commonly supported cantilevered load support surfaces in the wrapping area, each load support surface for supporting a separate load and having a free end;

rotating a cantilevered packaging material dispenser on a rotatable arm about a generally horizontal axis to wrap packaging material around the top and bottom of the load in the wrapping area when the selected cantilevered load surface is in a wrapping position, where the selected cantilevered load support surface and the cantilevered packaging material dispenser are generally aligned and intermeshed;

moving the commonly supported cantilevered load support surfaces to sequentially arrange each cantilevered load support surface in the wrapping position and in a load transfer position, where the wrapped load may be removed from the free end of the cantilevered load support surface in a generally horizontal direction without interfering with the cantilevered packaging material dispenser;

removing the wrapped load from the free end of the selected cantilevered load support surface in the wrapping area while the selected cantilevered load support surface is in the load transfer position; and transporting the wrapped load away from the plurality of commonly supported cantilevered load support surfaces and the wrapping area.

4. A method of wrapping packaging material around a load in a wrapping area, comprising:

positioning a load on a selected one of a plurality of commonly supported cantilevered load support surfaces in the wrapping area, each load support surface for supporting a separate load and having a free end;

rotating a cantilevered packaging material dispenser on a rotatable arm about a generally horizontal axis to wrap packaging material around the top and bottom of the load in the wrapping area when the selected cantilevered load surface is in a wrapping position, where the selected cantilevered load support surface and the cantilevered packaging material dispenser are generally aligned and intermeshed;

rotating the commonly supported cantilevered load support surfaces to sequentially arrange each cantilevered load support surface in the wrapping position and in a load transfer position, where the wrapped load may be removed from the free end of the cantilevered load support surface in a generally horizontal direction without interfering with the cantilevered packaging material dispenser;

removing the wrapped load from the free end of the selected cantilevered load support surface in the wrapping area while the selected cantilevered load support surface is in the load transfer position; and transporting the wrapped load away from the plurality of commonly supported cantilevered load support surfaces and the wrapping area.

5. A method of wrapping packaging material around a load in a wrapping area, comprising:

positioning a load on a selected one of a plurality of commonly supported cantilevered load support surfaces in the wrapping area, each load support surface for supporting a separate load and having a free end;

rotating a cantilevered packaging material dispenser on a rotatable arm about a generally horizontal axis to wrap packaging material around the top and bottom of the load in the wrapping area when the selected cantilevered load surface is in a wrapping position, where the selected cantilevered load support surface and the cantilevered packaging material dispenser are generally aligned and intermeshed;

transferring a load onto another one of the commonly supported cantilevered load support surfaces while the load is being wrapped on the selected cantilevered load support surface;

rotating the commonly supported cantilevered load support surfaces to sequentially arrange each cantilevered load support surface in the wrapping position and in a load transfer position, where the wrapped load may be removed from the free end of the cantilevered load support surface in a generally horizontal direction without interfering with the cantilevered packaging material dispenser;

removing the wrapped load from the free end of the selected cantilevered load support surface in the wrapping area while the selected cantilevered load support surface is in the load transfer position; and transporting the wrapped load away from the plurality of commonly supported cantilevered load support surfaces and the wrapping area.

6. A method of wrapping packaging material around a load in a wrapping area, comprising:

positioning a load on a cantilevered load support surface having a free end and being mounted on a turntable in the wrapping area;

rotating a cantilevered packaging material dispenser on a rotatable arm about a generally horizontal axis to wrap packaging material around the top and bottom of the load in the wrapping area when the cantilevered load surface is in a wrapping position, where the cantilevered load support surface and the cantilevered packaging material dispenser are generally aligned and intermeshed;

rotating the turntable about a generally vertical axis to wrap packaging material from a packaging material dispenser around the sides of the load;

moving the cantilevered load support surface to a load transfer position, where the wrapped load may be removed from the free end of the cantilevered load support surface in a generally horizontal direction without interfering with the cantilevered packaging material dispenser;

removing the wrapped load from the free end of the cantilevered load support surface in the wrapping area; and transporting the wrapped load away from the cantilevered load support surface and the wrapping area.

7. An apparatus for wrapping packaging material around the load in a wrapping area, comprising:

a cantilevered packaging material dispenser with a free end extending from an arm rotatable about a generally horizontal axis to wrap packaging material around the top and bottom of the load in the wrapping area; and a cantilevered load support surface with a free end mounted on a turntable and rotatable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser.

8. An apparatus for wrapping packaging material around the load in a wrapping area, comprising:

a cantilevered packaging material dispenser with a free end extending from an arm rotatable about a generally horizontal axis to wrap packaging material around the top and bottom of the load in the wrapping area; and a plurality of commonly supported cantilevered load support surface, each cantilevered load support surface for supporting a separate load and having a free end mounted and movable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser, wherein the plurality of commonly supported cantilevered load support surfaces are spaced such that one of the load support surfaces may be in the wrapping position when another of the load support surfaces is in the load transfer position.

9. An apparatus for wrapping packaging material around the load in a wrapping area, comprising:

a cantilevered packaging material dispenser with a free end extending from an arm rotatable about a generally horizontal axis to wrap packaging material around the top and bottom of the load in the wrapping area; and a plurality of commonly supported cantilevered load support surfaces, each cantilevered load support surface for supporting a separate load, each facing in a different direction and having a free end mounted and rotatable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser, wherein the plurality of commonly supported cantilevered load support surfaces are spaced such that one of the load support surfaces may be in the wrapping position when another of the load support surfaces is in the load transfer position.

10. An apparatus for wrapping packaging material around the load in a wrapping area, comprising:

a cantilevered packaging material dispenser with a free end extending from an arm rotatable about a generally horizontal axis to wrap packaging material around the top and bottom of the load in the wrapping area; and a cantilevered load support surface with a free end mounted on a turntable and movable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser;

wherein the turntable provides rotation about a generally vertical axis to wrap packaging material around the sides of the load.

11. An apparatus for wrapping packaging material around the load in a wrapping area, comprising:

a cantilevered packaging material dispenser with a free end extending from an arm rotatable about a generally horizontal axis to wrap packaging material around the top and bottom of the load in the wrapping area; and a cantilevered load support surface with a free end mounted on a turntable and movable in the wrapping area between a wrapping position, where the cantilevered load support surface and the cantilevered packaging material dispenser are generally aligned and intermeshed, and a load transfer position, where the wrapped load may be removed from the free end of the load support surface in a generally horizontal direction without interfering with the cantilevered packaging material dispenser;

wherein the turntable provides relative rotation between a second packaging material dispenser and the load to wrap packaging material around the sides of the load.

* * * * *

UNITED STATES PATENT AND TRADEMARK OFFICE

CERTIFICATE OF CORRECTION

PATENT NO. : 6,151,863
DATED : November 28, 2000
INVENTOR(S) : Lancaster, III, et al.

It is certified that error appears in the above-identified patent and that said Letters Patent is hereby corrected as shown below:

Title page, column 1,
Item [73], lines 1-2, after "Lantech Holding Corp." insert -- d/b/a Lantech, Inc --.

Signed and Sealed this

Sixth Day of November, 2001

*Attest:*

Nicholas P. Godici

*Attesting Officer*

NICHOLAS P. GODICI
*Acting Director of the United States Patent and Trademark Office*